United States Patent [19]

Lavoie

[11] Patent Number: 4,523,339

[45] Date of Patent: Jun. 18, 1985

[54] SINK DRAIN VALVE

[76] Inventor: Gérard Lavoie, 467 Principale St., Ville Dègelés, Quebec, Canada, G0L 1H0

[21] Appl. No.: 507,485

[22] Filed: Jun. 24, 1983

[51] Int. Cl.[3] ..... E03C 1/00

[52] U.S. Cl. ..... 4/191; 4/194; 4/619; 251/326; 251/327

[58] Field of Search ..... 4/191, 192, 194, 619, 4/193; 251/326, 327

[56] References Cited

U.S. PATENT DOCUMENTS

| | | | |
|---|---|---|---|
| 1,333,826 | 3/1920 | Yeiser | 4/194 |
| 1,788,216 | 1/1931 | Watrous | 4/194 |
| 3,575,377 | 4/1971 | Carlton et al. | 251/327 X |
| 3,844,531 | 10/1974 | Grengs | 251/327 |
| 3,941,349 | 3/1976 | Pierson | 251/326 X |
| 3,945,604 | 3/1976 | Clarkson | 251/326 X |
| 4,377,274 | 3/1983 | Mayhew, Jr. | 251/327 |

*Primary Examiner*—Henry K. Artis

[57] ABSTRACT

In a kitchen sink, it is known to have a drain plug at the bottom of the sink; it is unpleasant to remove this plug when the sink is full of liquid. In this invention, a sliding valve controls the flow of liquid from the sink within the sink drain tube. An apertured sliding plate is housed within a two-part bored casing connected to the sink drain tube. Pushing the sliding plate toward the sink drain tube closes the latter and vice-versa. A pivotable handle surmounting the sink activates the sliding plate through a multi-lever connecting link. The two casing parts are fitted with a gasket in between and are detachable. Each part is welded to a drain nipple. The two drain nipples are series connected in the drain line. The entire assembly is easily installed and removed.

1 Claim, 3 Drawing Figures

A
B

SINK DRAIN VALVE

FIELD OF THE INVENTION

This invention relates to a sliding gate valve to close the drain of a sink such as a kitchen sink.

BACKGROUND OF THE INVENTION

It is common in a kitchen sink to have a drain plug at the bottom of the sink. To remove the plug, therefore, one has to reach the plug and pull it. When the sink holds a hot liquid and/or refuse, removing the drain plug may prove at the least unpleasant. Canadian Pat. No. 159,074, dated December 1910, shows a wedge H slideable in guide I to open or close the sink drain tube K of the bowl A. However, guide I is fixed at the bottom of bowl A, and a second bowl B is required; this mean considerable alteration to the standard wash basin.

OBJECTS OF THE INVENTION

It is therefore a prime object of the invention to provide standard wash basins, more particularly a kitchen sink, with a simple, inexpensive drain valve activated outwardly of the sink.

It is a further object of this invention to provide a sink drain valve which can be easily installed and removed.

Other objects will be more apparent in the detailed description of the drawings.

SUMMARY OF THE INVENTION

A sliding gate valve is provided at the level of the sink drain tube. Such sliding gate is operable by a pivotable handle, located outwardly of the sink, and connected to the sliding gate by a multi-level connecting link. Pulling the handle toward the user effectively pushes the sliding gate to close the sink drain, while pushing the handle outwardly of the user reopens the sink drain.

The slidable gate engages a slotted casing, comprising two detachable mating parts each welded to a drain nipple easily installed in the drain line.

DETAILED DESCRIPTION OF THE INVENTION

Figures 1, 2, 3:
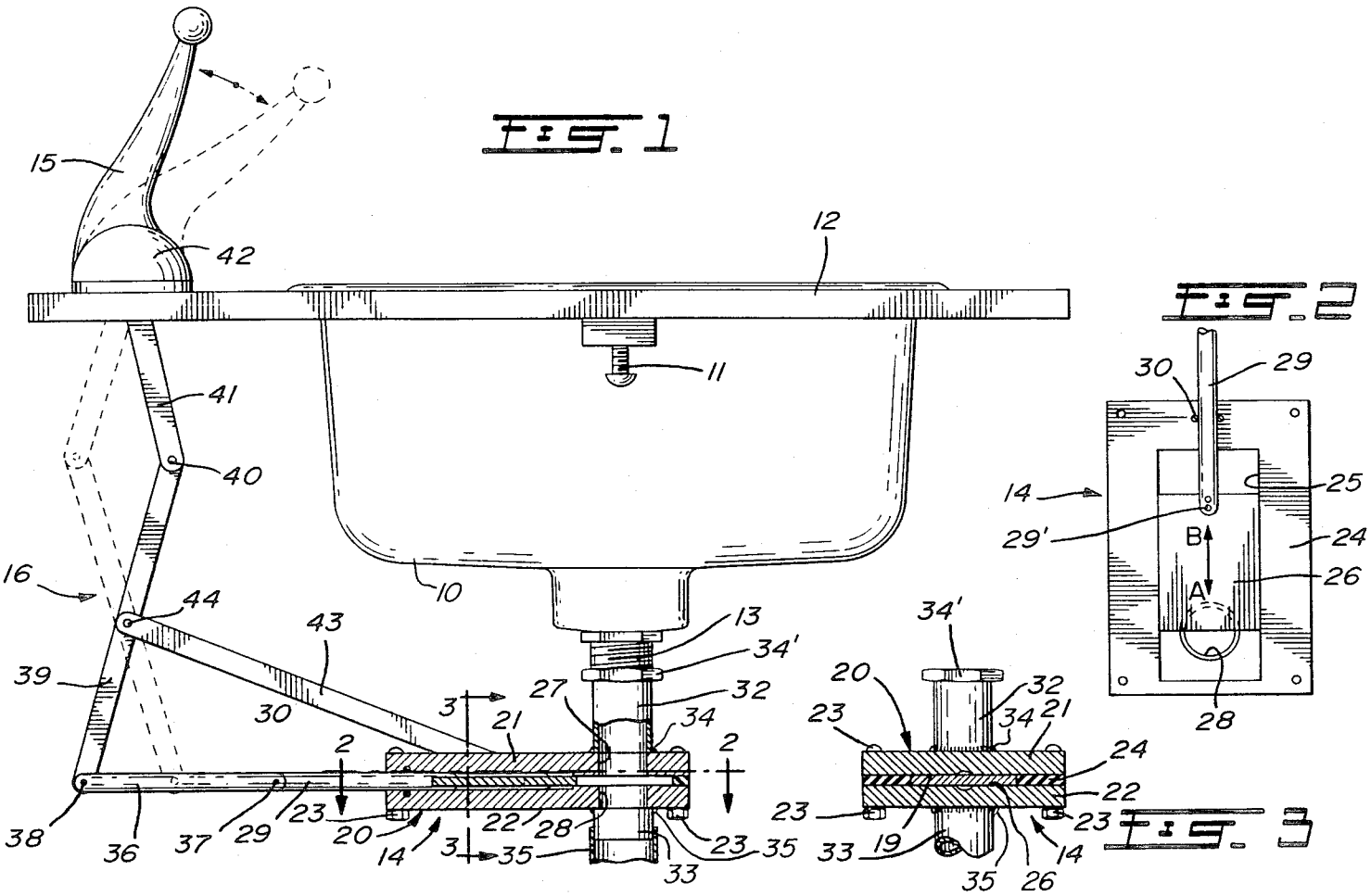
FIG. 1 is an elevation of a kitchen sink, including the drain valve assembly, the valve itself being in section.
FIG. 2 is a plan view taken along line 2—2 of FIG. 1.
FIG. 3 is a cross-section taken along line 3—3 of FIG. 1.

The mechanism illustrated is associated with a wash basin, preferably a kitchen sink 10, of any conventional type, fixed by screwing means 11 within an opening of a kitchen counter 12, and provided with a conventional externally threaded drain nipple 13.

The sink drain closing mechanism is constituted of three main parts: a gate valve 14 a pivotable valve-operating handle 15, mounted on counter 12 at the back of the sink 10 and a multilever connecting linkage 16, connecting valve arrangement 14 to pivotable handle 15.

The sliding gate valve arrangement 14 includes a casing 20 made of two upper and lower plates 21 and 22 detachably secured together by bolts and nuts 23 with the interposition of a gasket 24. The latter has a rectangular opening 25 in which is movable a rectangular valve plate 26 between a valve closing position between the two registering holes 27, 28 of casing plates 21 and 22 and valve opening position uncovering said holes 27, 28. An actuating rod 29 is fixed to valve plate 26 at 29' and extends in the plane of plate 26 and through an O-ring 30 exteriorly of casing 20. Top and bottom drain nipples 32 and 33 are welded at 34, 35 to the top and bottom casing plates 21, 22 respectively in register with holes 27, 28. Top nipple 32 retains a nut 34 to be screwed to sink nipple 13. Bottom nipple 33 simply slidably fits within the conventional drain pipe 35.

The connecting linkage is shown as having three arms. The first arm 36 is pivoted at 37 and 38 to rod 29 and to second arm 39 in turn pivotally connected at 40 to the free end of a third arm 41 which is fixed to handle 15 which is pivoted to a base 42 fixed to counter top 12. A bracket 43 is pivotally connected to the center of arm 39 at 44 and downwardly extends towards and is fixedly connected to the upper plate 21 of casing 20.

To close the drain, the user proceeds in the manner that will now be outlined. The handle 15 is pulled towards the sink 10, to the dotted position of FIG. 1. This also brings the lower end of arm 39 toward the sink 11 and thus rod 29 within the casing 20. Therefore valve plate 26 closes the sink drain.

Pushing the handle 15 outwardly of sink 11 will draw rod 23 outwardly of casing 20, thus opening the drain.

The valve is easily installed. With the two casing parts separated, the nipple 33 of bottom casing part 22 is inserted in drain pipe 35, the valve 14 is assembled by bolts and nuts 23 and nipple 32 is connected to sink nipple 13 by nut 34. The linkage 16 and handle 15 are installed. Valve 14 can be easily disassembled for servicing by a reverse procedure.

What I claim is:

1. The combination of a liquid-containing basin having a downwardly-extending outlet tube, of the vertical portion of a lower drain pipe, said vertical portion co-axial with and vertically spaced from said outlet tube, with a closing mechanism controlling the flow of liquid from said basin between said outlet tube and said vertical drain pipe portion; said mechanism including top and bottom plates, each having a transverse small hole and removably secured one to the other in face-to-face relation, a gasket installed between the peripheral edge portions of said plates and defining an inner chamber in conjunction with said plates, said plate holes being in register and opening into said chamber; top and bottom drain nipples fixedly and permanently secured to said top and bottom plates, respectively, in registry with said plate holes and in co-axial arrangement, the outer ends of said top and bottom drain nipples being removably secured co-axially to said outlet tube and to said vertical drain pipe portion, respectively; a gate valve plate movable in said chamber transversely of said plate holes, a rod secured to said valve plate, co-planar therewith and protruding from one end of said top and bottom plates; an operating handle pivotally mounted adjacent said basin, and a multi-lever arrangement operatively interconnecting said handle to said rod, whereby operation of said handle will move said valve plate within said chamber between a position across said plate holes and a position clearing said plate holes.

* * * * *